US005791097A

United States Patent [19]

Winston et al.

[11] Patent Number: 5,791,097

[45] Date of Patent: Aug. 11, 1998

[54] EARTH TREMOR SUPPRESSING CABLE SUSPENSION SYSTEM FOR BUILDINGS BRIDGES AND HOMES

[76] Inventors: Paul K. Winston, 9401 E. Chenango, Englewood, Colo. 80111; Dale C. Sommers, P.O. Box 867, Conifer, Colo. 80433

[21] Appl. No.: 451,208

[22] Filed: May 26, 1995

[51] Int. Cl.[6] ..... E02D 27/34

[52] U.S. Cl. ..... 52/167.1; 52/167.3

[58] Field of Search ..... 52/167.1, 167.4, 52/167.6, 167.7, 167.8, 1, 167.3

[56] References Cited

U.S. PATENT DOCUMENTS 5,259,159 11/1993 Kawase et al. ..... 52/167.1

*Primary Examiner*—Carl D. Friedman
*Assistant Examiner*—Creighton Smith

[57] ABSTRACT

A method of supporting structures, embodied as a multiple telescoping pier, multi-point, interconnected cable and pulley supple support mechanism especially for use on prefabricated buildings, platforms and bridges which are built on land areas which have a known history of experiencing earth tremors, earthquakes, or ground swelling.

2 Claims, 9 Drawing Sheets

EARTH TREMOR SUPPRESSING CABLE SUSPENSION SYSTEM FOR BUILDINGS BRIDGES AND HOMES

FIELD OF THE INVENTION

The field of the present invention relates to the art of cable suspension and oscillation motion damping means, as applied to buildings and bridges desired to be built and placed within a known earth tremor prone area. The present invention specifically relates to a cable type gravity operated, multi-point earth oscillation compensating, building platform suspension unit, provided with multiple earth embedded "sensors" connected to parallel telescoping piers that instantly telegraph motion, and the interconnected cables transfer compensatory motion to adjacent companion suspension components, and the present invention cable suspension system thusly serves to autolevel the supported structure during seismic motion.

BACKGROUND OF THE INVENTION

As the surface of our earth grows and shifts with movement of the underlying geologic continental plates, land regions often experience earth tremors or earthquakes. Some land regions experience these tremors on a regular basis, but it has been found desireable to place buildings, dwellings and bridges in those regions. Oftentimes, structures such as these are damaged or completely destroyed during seismic activity, and subsequently need to be replaced.

When replacing such structures, conventional construction techniques employ heavy reinforcing of the replacement structure, adding reinforcing beam structures, re-pouring concrete footings with additional embedded reinforcing, including strapping down and securing appliances and heavy furnishings, et cetera. Ground swelling such as found in land areas with expansive soil like bentonite, clay, or regions with permafrost requires buildings to have extremely rigid foundations, structures which can withstand the earth swelling pressures present, soil amendments to the building site, or lengthy cassions which connect to the underlying bedrock. During moderate or light seismic activity, these construction methods protect a building from damage to a degree, but presently the search continues for an acceptable and reliable quake zone construction technique for new structures and remodels.

Other previous techniques of providing for earthquake proofing of a building structure are illustrated by the prior art references following. Included among these techniques are those which utilize a suspended counterweight assembly disclosed in U.S. Pat. No. 3,940,895 by Yamamoto et al; the base weighted obround spherical structure as is found in the U.S. Pat. No. 3,916,578 of Forootan et al; the spring supported resilient floor structure described in the U.S. Pat. No. 3,606,704 issued to Clyde T. Denton; the slidable and rotatable bearing support footing of U.S. Pat. No. 3,105,252 by Robert L. Milk; and the flexible saddle mount to be used on a spherical tank illustrated in U.S. Pat. No. 3,606,715 by Walter Wyss and Peter Feverlein.

Elegant cable suspended bridges have been in use in earthquake prone areas without experiencing significant damage from tremors, including the famous Golden Gate Bridge in San Francisco Calif. Inventors have successfully improved upon this basic cable suspension method, designing for cable suspension bridges and also marine ship to dock load handling cable suspensions, both of which compensate for movement relative to the cable anchor point.

Illustrative of such cable suspension techniques are; the cable-stayed bridge of John Muller, described in U.S. Pat. No. 5,121,518, and also the John Muller U.S. Pat. No. #5,241,721; the counterweighted offshore crane wave motion compensating apparatus disclosed in U.S. Pat. No. 4,544,137; the hydraulic ram assisted sea swell compensating apparatus found in U.S. Pat. No. 4,236,695 by Archibald J. S. Morrison; a multiple pulley hydraulically actuated portable balanced motion compensated lift apparatus found in U.S. Pat. No. 4,593,885 of Donald J. Hackman, Don W. Caudy, and Leslie F. Nikodem; and the hydraulically tensioned lifting apparatus outlined in the U.S. Pat. No. 4,025,055 of William Josef Strolemburg.

Additionally, the cable type road vehicle suspension systems have proven to be of good utility and design, such as the hydraulic assisted lever and cable suspension system for road vehicles found in U.S. Pat. No. 2,823,926 of A. C Stover; and the adjustable compensating tandem wheel cable and lever suspension for vehicles and trailers disclosed in the U.S. Pat. No. 3,304,097 of O. M. Lewis.

These references of the art are brought into view as embodiments of the art of earthquake resistant structures and as illustrative of the art of cable suspension assemblies in general.

Disclosed by the applicant to the PTO on Mar. 20 1995 in a package submitted under the Disclosure Document Program, Ser. No. 372,752, it is a primary object of the present invention to overcome deficiencies in present construction techniques and the prior art methods of earthquake proofing of buildings and structures by now providing for a multi-point, multiple pier, moveable cable supple suspension system to be used on prefabricated buildings, building platforms, bridges and the like, which suspension system is capable of absorbing earth movement, and the suspension system is permanently anchored to the building site, and resiliently supports the structure above it.

It is a further object of the present invention to provide an adjustable and equalizing cable suspension system for supporting a structure above, which will be of very simple and practical construction, moderate in cost, transparent in operation, easy to install, and having no special maintenance requirements.

SUMMARY OF THE INVENTION

The present invention in the preferred embodiment comprises a resilient, earth tremor/earth movement suppressing suspension mounting for use in supporting prefabricated buildings, building platforms, bridges, and the like. The suspension is securely bracketed and affixed to laminated perimiter foundation beams comprising the preferred base of the supported structure. Through the use of a series of anchored heavy duty telescoping, compressible-expandible hollow piers operating in conjunction with a multiplicity of heavy duty pulleys mounted within and thereupon, and a multistrand metallic cable running between the individual piers as an interconnected cable network, the present cable suspension system firmly anchors and resiliently holds and supports the structure above.

The hollow piers lowermost earthen anchor point serves as a 'ground sensor' and any vertical motion at the 'sensor' is immediately telegraphed through the adjoining cable network to all adjacent piers in the present cable suspension system. Through the telegraphing of vertical motion, the supported structure remains leveled relative to any earth wave or earth swell motion. The design of the preferred embodiment provides for an overall vertical motion capacity of approximately 3 feet, allowing for absorbtion of earth wave movements of record, although larger or smaller vertical motion capacities could be designed for.

Earth shaking motions are compensated for by the present invention through use of sliding/rotatible captive mounting platforms which allow for a side to side motion capacity of 6 inches overall, 3 inches from centerpoint in the present embodiment. Larger side to side motion could be designed for however, by increasing the scale of size. The sliding/ rotatible mounting platforms are placed directly above the 'ground sensor' and are connected to and are present at each pier individually. The sliding/ rotatible mounting platforms co-operate with the present cable suspension system to provide for a stable platform capable of withstanding repetitive earth movements, either earth waves or earth shaking, or both in combination. An optional thick neck ball joint leveling coupler is mountable at the base of each individual pier, positioned below the mounting platform, for building use in vicinities experiencing repeated severe earth movement activity. The leveling ball coupler provides for a 45 degree or greater horizontal movement capacity of the individual concrete footings, relative to the suspension pier, the perimiter beam, and the supported structure.

The present cable suspension system is protected and contained under the supported structure through use of a series of laminated panelized 'basement wall panels' which reside within and between metallic I beam containment channels. The I beam channels are vertically driven deep into the earth outboard of the supported structure 'drip line' and project upwardly to a variable dimension dependent on building sites. The panelized wall panels are preferably faced with a rot and moisture proof, semi flexible facing such as compressed silica board or fiberglass composites, and the panels are filled with an insulative bonding foam between the facings. A flexible skirt membrane provides a weather and rodent proof cap which is capable of movement with the supported structure. The skirt membrane is mounted to the supported structure and overlaps the panelized basement wall panels, and is bermed into the earth beyond the drip line adjacent to the supported structure. In the case that the supported structure is a residence or inhabitable structure of any type, a series of flexible utility connectors is also employed in the present suspension system to allow for a degree of supported structure movement without interrupting utility service to the structure.

BRIEF DESCRIPTION OF THE DRAWINGS

FIG. 3*a* is a frontal view of FIG. 3,

FIG. 3*b* is a side view of FIG. 3.

DETAILED DESCRIPTION OF THE DRAWINGS

Disclosed hereby is a freestanding cable suspension assembly which can be packaged as a kit and assembled at an on-site building location and is identified as a mulitpoint cable suspension system and method of supporting structures, to serve as a pier type foundation to be used on prefabricated homes, buildings, bridges- and the like- which are built on land or in geographic zones which have a known history of experiencing earth tremors, earthquakes, ground swelling, or permafrost.

Figure 1:
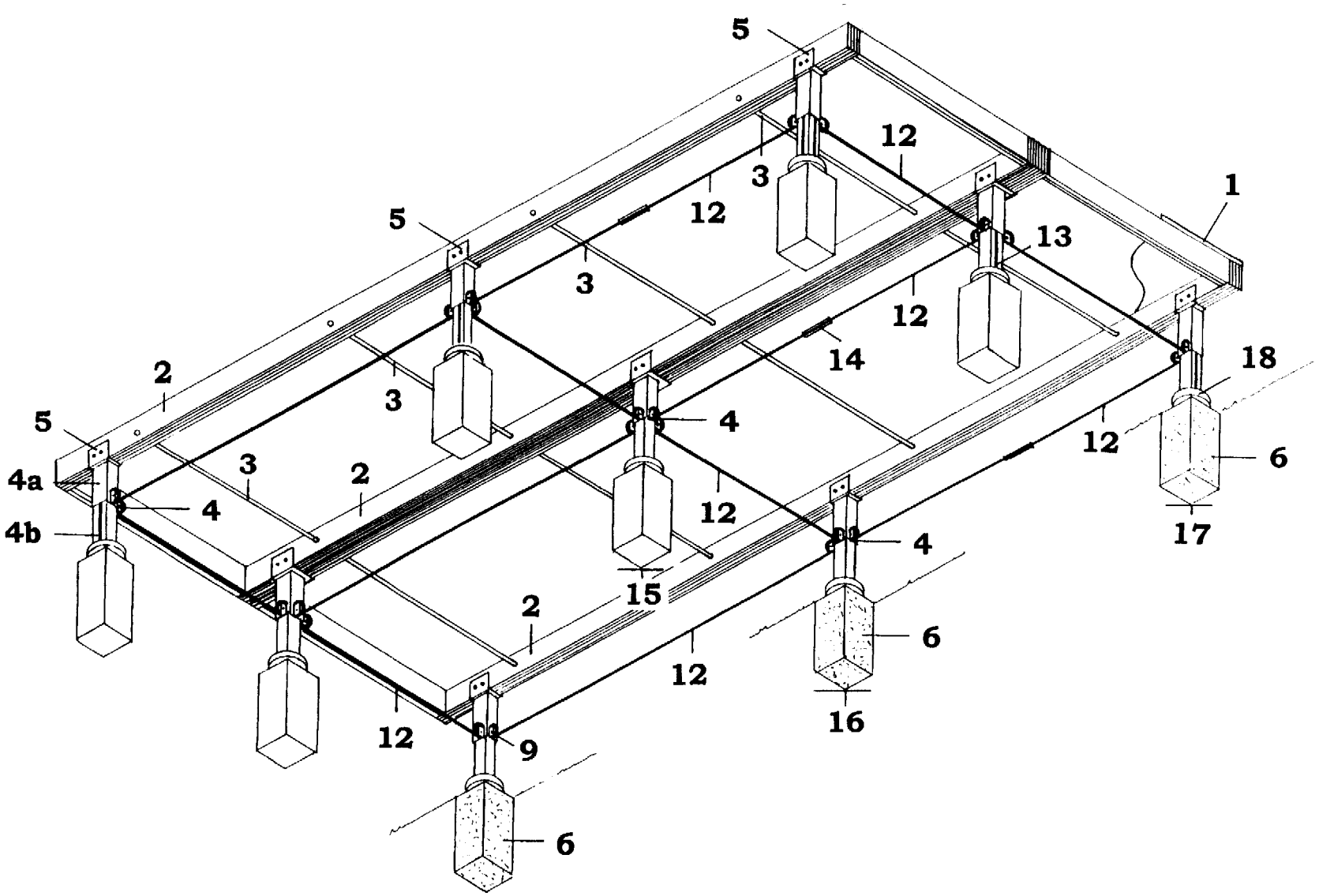
FIG. 1 Is an underside isometric view of the cable suspension system.
Figures 2, 2A, 2B:
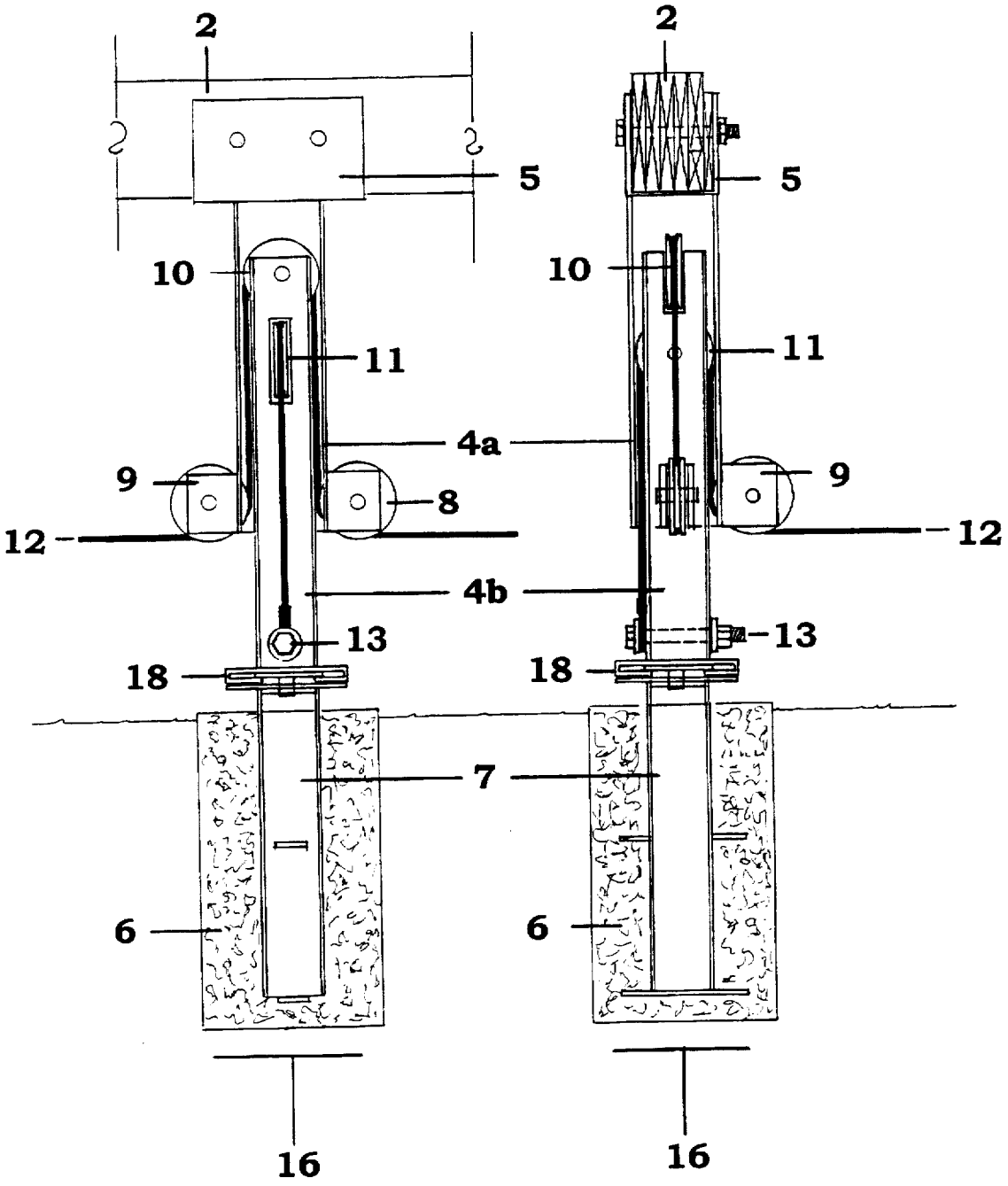
FIG. 2 Is a cutaway view of a suspension pier, shown under load; where
FIG. 2*a* is a frontal view of FIG. 2.
FIG. 2*b* is a side view of FIG. 2.
Figure 3:
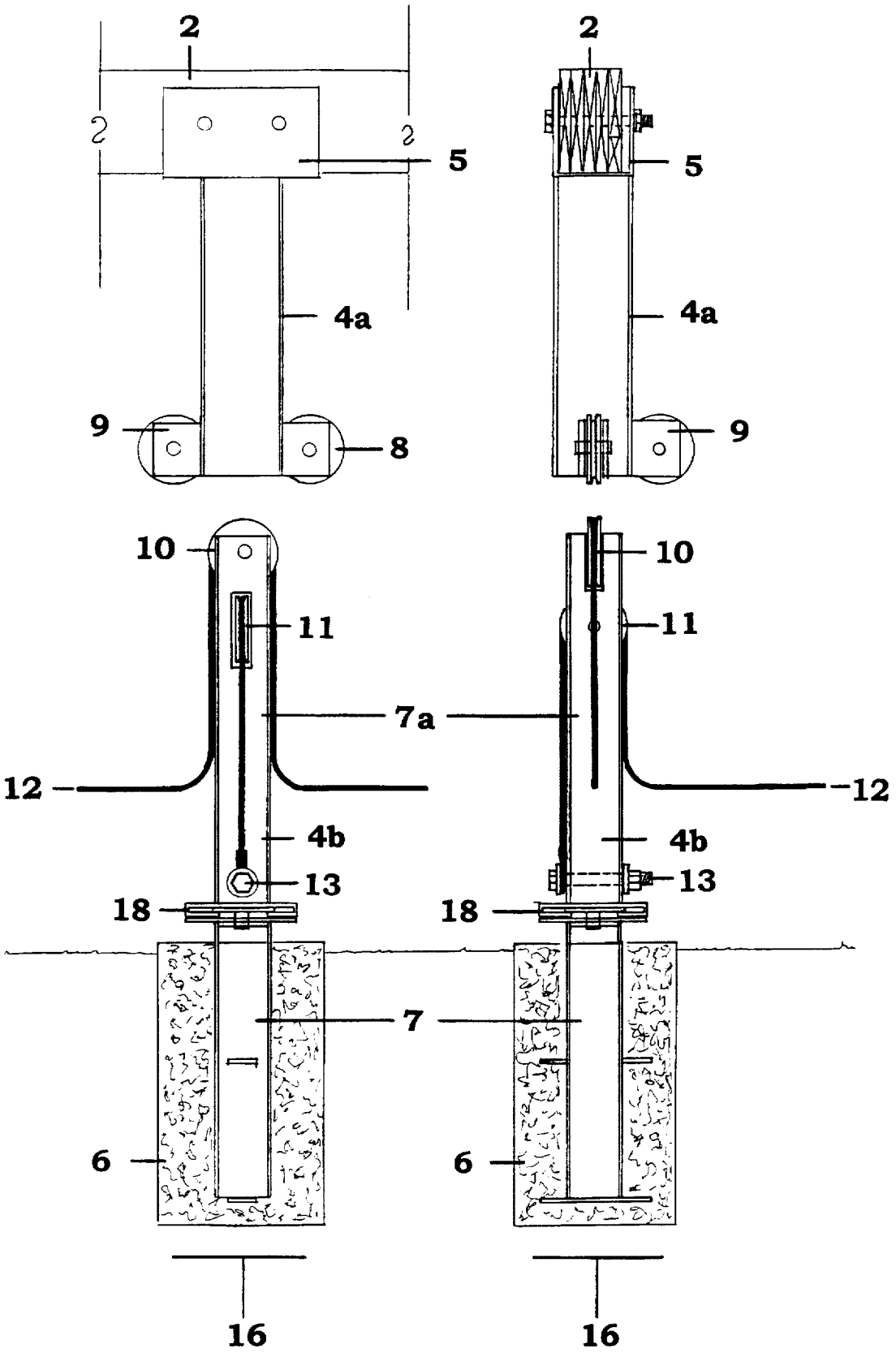
FIG. 3 is a cutaway exploded view of a suspension pier not under load.
Figure 4:
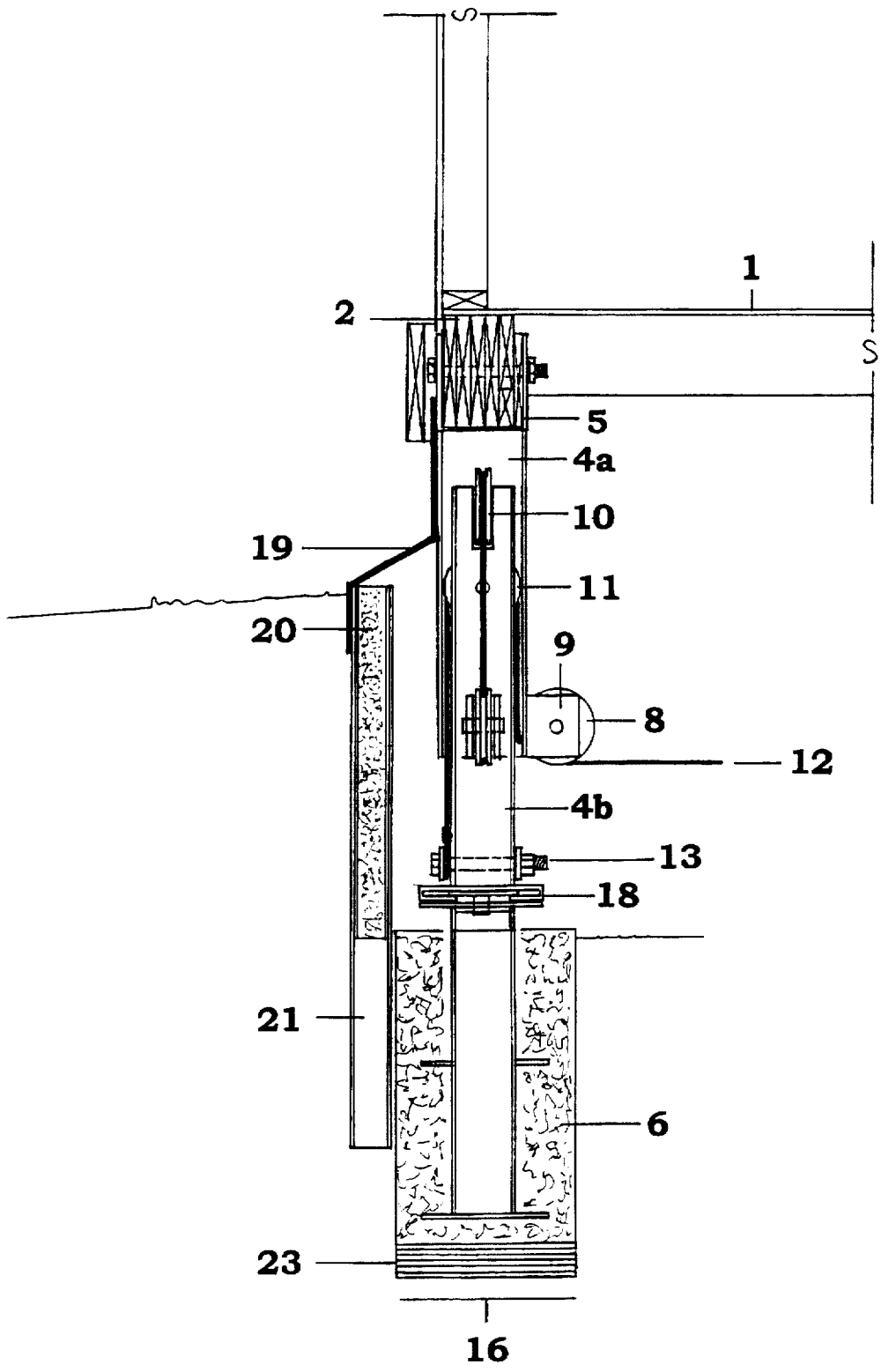
FIG. 4 is a cutaway elevation view of a suspension pier, showing the protective membrane and wall panels.
Figure 5:
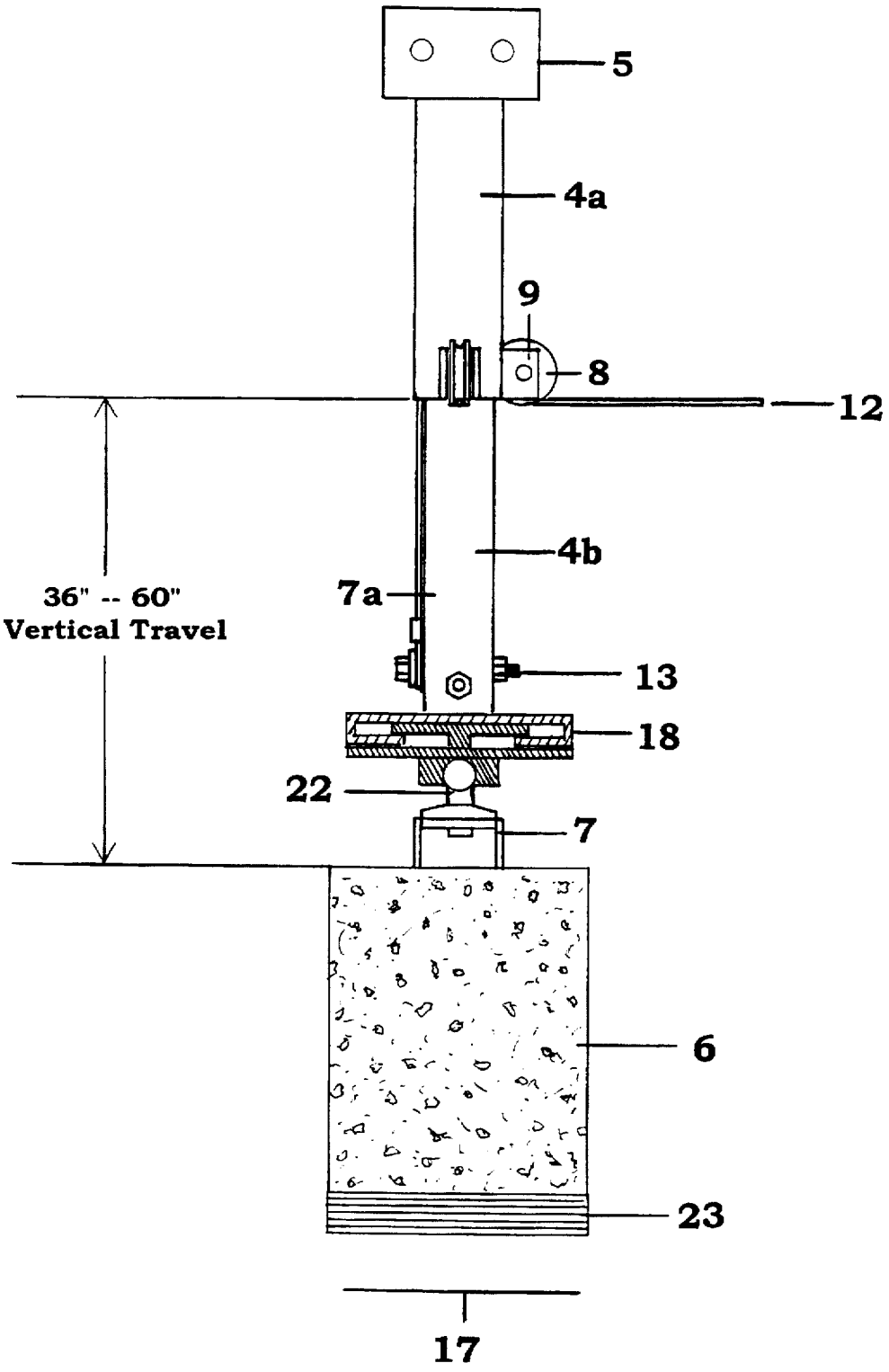
FIG. 5 is a side view of a suspension pier, cutaway at the sliding/rotatible mounting foot, illustrating preferred vertical travel capacity of the suspension pier.
Figure 6:
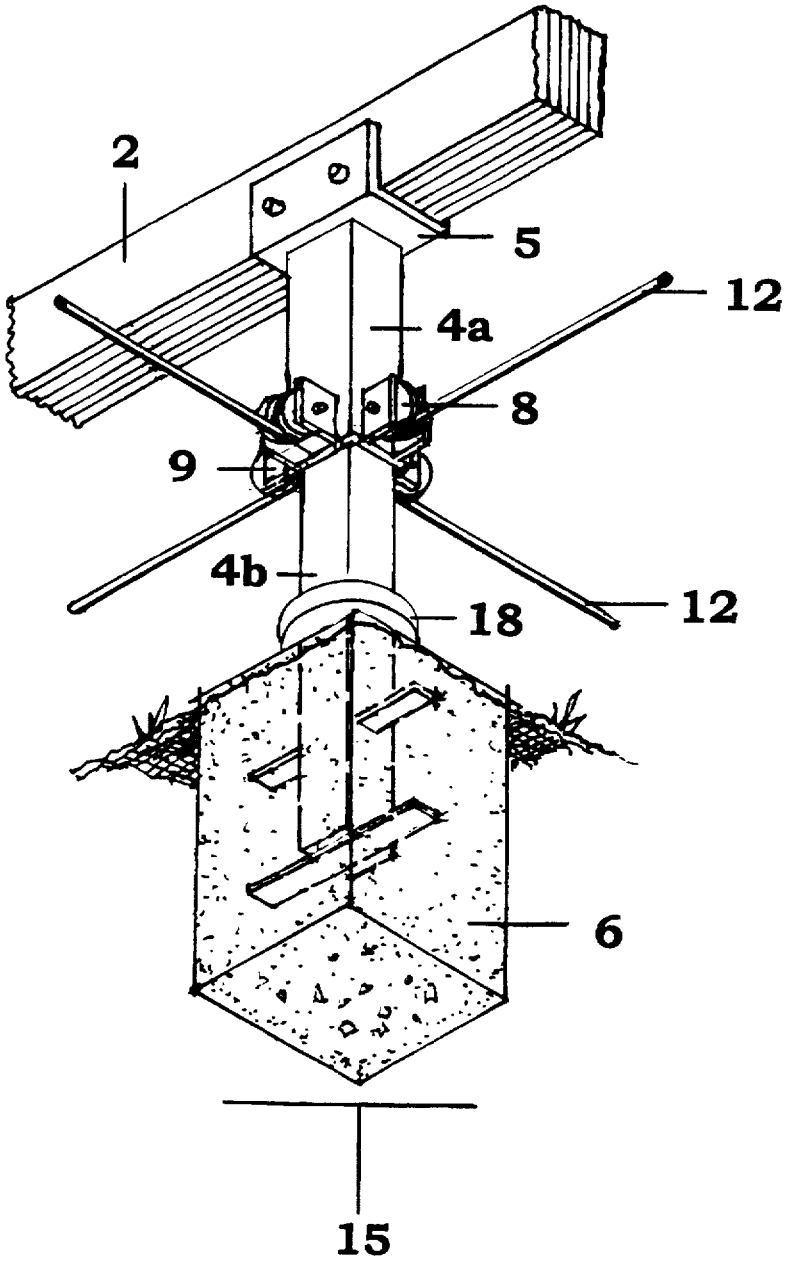
FIG. 6 is an underside isometric view of an 'X' cable crossing suspension pier.
Figure 7:
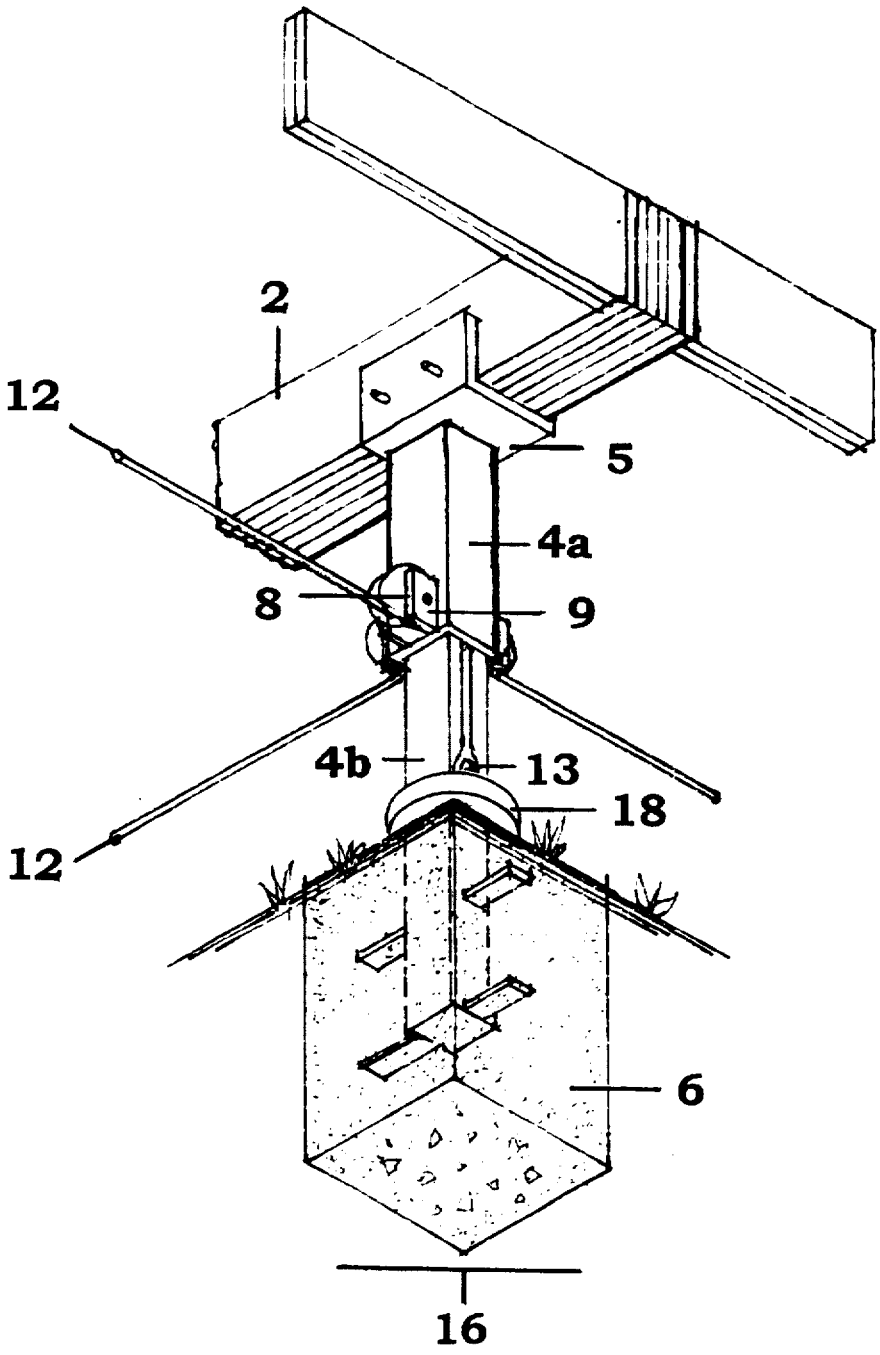
FIG. 7 is an underside isometric view of a 'T' cable crossing suspension pier.
Figure 8:
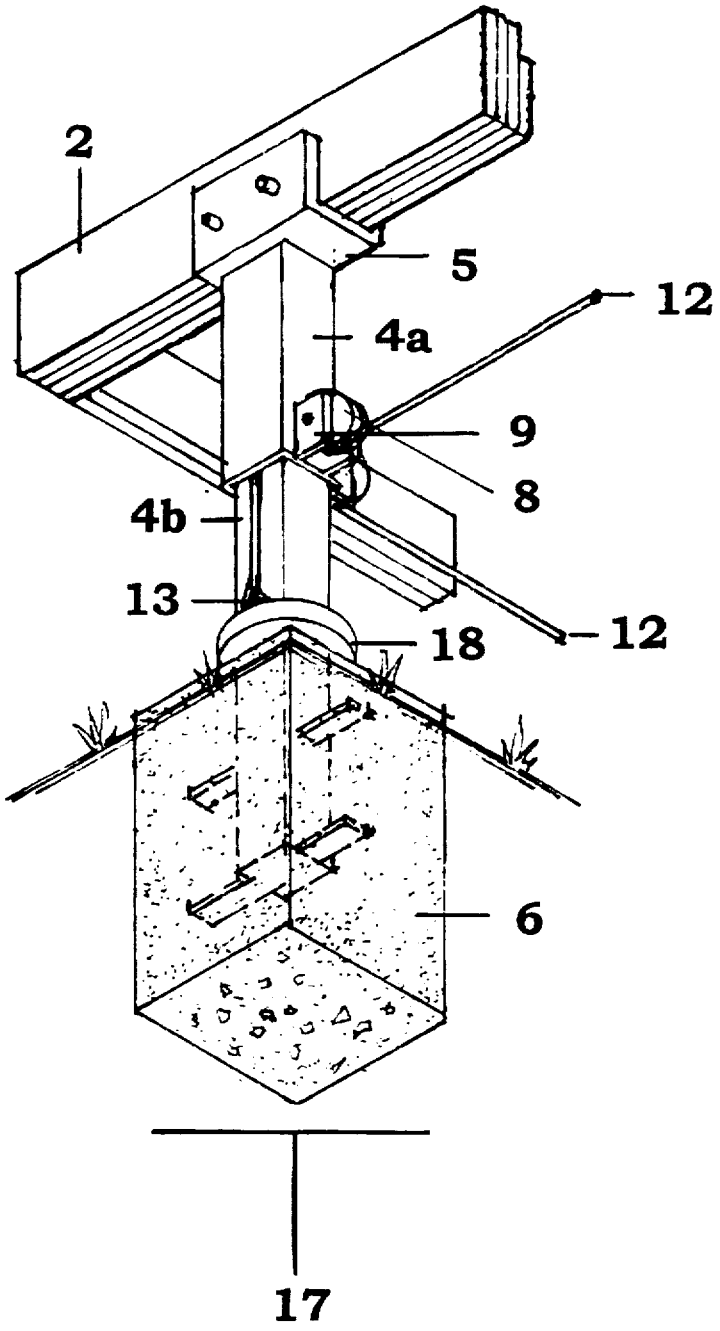
FIG. 8 is an underside isometric view of a 'L' cable crossing suspension pier.
Figure 9:
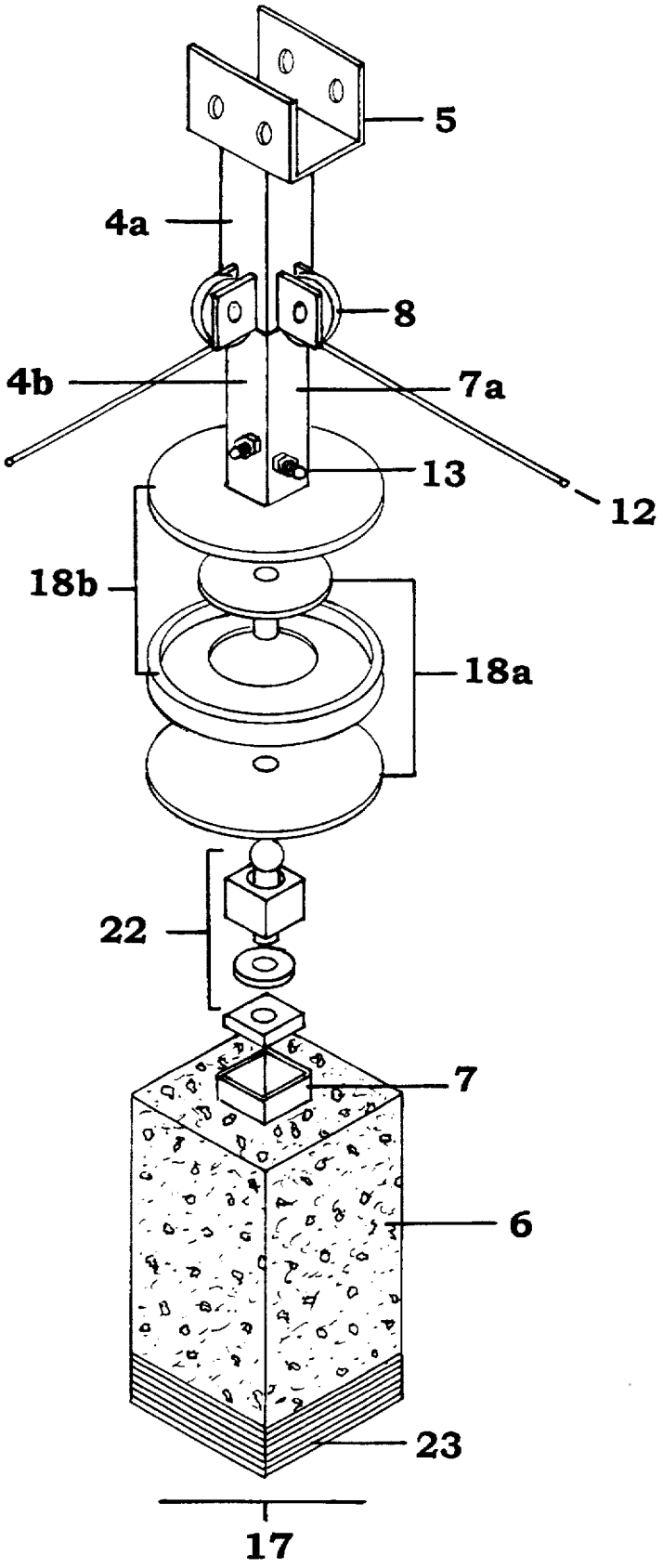
FIG. 9 is a top isometric view of an exploded 'L' cable crossing suspension pier, illustrating a sliding/rotatible platform and the ball joint coupler mounted below it.

With reference to the attached drawings, FIGS. 1–9, the multipoint cable suspension system is comprised of several distinct parts, and is supportive to a structure mounted above it, the structure represented herein generally as the decking 1, and the present system basically requires the use of a multistrand corrosion resistant metallic cable 12, forged steel pulleys 8, 10, 11, and several large, dimensional, heavy duty, square steel tubing elements which form a telescoping suspension pier. The telescoping tubing sections, when nested and assembled together comprise a telescoping suspension pier 4. The tubing sections telescope and nest parallel inside one another, (and are hereinafter called the inner tubing section 4*b* and the outer tubing section 4*a*). Throughout the present invention, a series of heavy duty deep groove steel pulleys 8, 10, 11 with oversized axles are employed, and two of these pulleys 10, 11 reside internally to the inner tubing section 4*b*, with an additional series of two (or more) lower pulleys 8 residing externally upon the outer tubing section 4*a*.

The outer tubing section 4*a* is provided with a beam mounting bracket 5 which also serves as the uppermost end cap. This bracket 5 is securely bolted to a laminated wooden dimensional beam 2 which comprises the supported structure's foundation perimiter and central support beams. The laminated beam 2 is blocked and fastened to a conventional joist system in a maimer as is known in the art. This technique is known as "Wooden Post Tension Frame Construction". The laminated beam is separated by the conventional joists from it's twins that are mounted parallel. A series of three or more threaded steel clamping post tension rods 3 penetrates and spans the distance between both of the opposing parallel laminated beams 2. The post tension rods are tightened using locknuts and securely serves to hold the opposing laminated beams 2 in tension onto the conventional joists. A decking 1 is attached to the uppermost face of the laminated beam 2.

The outer tubing section 4a is fitted with a plurality of lower pulleys 8 (two, three, or four individual pulleys). These plurality of lower pulleys 8 are permanently mounted externally onto the outer tubing section 4*a*, with strong steel brackets 9, and this bracket 9 and lower pulley 8 assembly is located near the lowermost end of the outer tubing section 4*a*. These lower pulleys 8 and the brackets 9 extend vertically outward at 90 degrees from the flattened face of the outer tubing section 4*a*. Preferred construction methods employed in the manufacture of the outer tubing section 4*a* describes and identifies three distinct subsets:

Subset 1, which has four individual lower pulleys 8 externally mounted to the lowermost base of the outer tubing section 4*a;*

Subset 2, which has three individual lower pulleys 8 externally mounted to the lowermost base of the outer tubing section 4*a;*

Subset 3, which has two individual lower pulleys 8 externally mounted to the lowermost base of the outer tubing section 4a.

Each of the above identified outer tubing 4a subsets is designated for placement at specific locations within a cable grid defined by the present cable suspension building support system:

Subset 1 is to be placed as an central cable suspension pier, and employs the use of two individual cables 12. It is known as an "X" cable crossing suspension pier 15.

Subset 2 is to be placed as an outboard or building perimeter cable suspension pier, and employs the use of two individual cables 12. It is known as a "T" cable crossing suspension pier 16.

Subset 3 is to be placed as a perimeter comer anchor cable suspension pier, and employs the use of two individual cables 12. It is known as a "L" cable crossing suspension pier 17.

The inner tubing section 4b has its lowermost ⅔ portion embedded into concrete footings 6. This embedded portion of the inner tubing section 4b is identified as the footing mount segment 7. This footing mount segment 7 of the inner tubing section 4b has several "deadman" type of extrusions along its length to assist in securing and anchoring this segment 7 to the concrete footing 6. In the preferred embodiment, a resilient mounting foot 23 is provided underneath the concrete footing 6, as a lowermost bearing point for the concrete footing 6, and the concrete footing 6 rests upon the resilient mounting foot 23. The resilient mounting foot 23 provides for an initial shock impact absorbtion of sudden earth wave activity.

A further set of pulleys reside within and are contained upon the upper portion of the inner tubing section 4b: They are hereinafter identified as the upper pulley 10, and the intermediate pulley 11. The upper pulley 10 is located within a channel at the uppermost extremity of the inner tubing section 4b. It is rotatable along a horizontal axis and is vertically mounted. The intermediate pulley 11 sits in a recessed opening which penetrates clearly through the mid-section of the inner tubing 4b height and the intermediate pulley 11 is placed directly below the upper pulley 10. The intermediate pulley 11 is preferably placed at a an angle 90 degree opposed to the relative vertical position of the upper pulley 10. The intermediate pulley 11 is also rotatable on a horizontal axis and is vertically mounted.

The intermediate pulley 11 and the upper pulley 10 have a diameter equal to or slightly less than that of the interior dimension of the outer tubing section 4a which surrounds both these pulleys 10, 11 after assembly. Thereby, the intermediate pulley 11 and the upper pulley 10 serve as bearing blocks to prevent rocking or excessive side to side freeplay of the outer tubing section 4a as the outer tubing section 4a moves vertically during suspension travel. A set of pillow blocks serve to provide this function at the base of the outer tubing section 4a and are provided only where no cable 12 passes within this juncture, such as on a 'T' or 'L' cable crossing suspension pier 4.

A heavy flathead cable stay bolt 13 is inserted at the base of the inner tubing section 4b, and penetrates through the inner tubing section 4b, near the concrete footing embedment 6. The flathead cable stay bolts 13 are placed so as to reside inline and underneath the inner tubing section pulleys 10, 11, which they serve, either serving the upper pulley 10 or serving the intermediate pulley 11, relative to a 'T' or an 'L' cable crossing suspension pier 4 . The bolts 13 are held in place by hex nuts and flat steel washers as is known in the art.

The present invention in its present form utilizes an interconnected network of high strength non corrodible large diameter cables 12 spanning the distance between pier sections 4 and the cable 12 loops through the tubing sections 4 and rests upon the pulleys 8, 10, 11 within the cable suspension system. A cable tensioning locking turnbuckle 14 is employed at each individual strand of cable 12 in the present cable suspension system, to facilitate cable 12 placement in relation to the assembled suspension piers 4. The cable network interacts with all of the inner tubing section 4b and outer tubing section 4a pulleys 8, 10, 11. As viewed from above, each individual cable 12 follows a straight line course, and when viewed from the side, the cable 12 follows a serpentine course. Each individual cable 12 serves only ONE line of a variable size grid of the cable 12 network in the present invention.

The primary cable routing technique utilized in the present invention describes the following cable course: At its free ends, each individual cable 12 is securely anchored to the cable anchor bolts 13. Originating at this anchor point 13, and viewed from the side, the cable 12 proceeds vertically upwardly, (being contained within the outer tubing section 4a) and then passes over the upper pulley 10, then proceeds vertically downwardly and passes under a lower pulley 8, then proceeds horizontally in free space to the next inline suspension pier 4, then passing under a lower pulley 8 there, and then proceeds vertically upwardly (within the outer tubing section 4a) to pass over an upper pulley 10, etc. . . . finally being anchored at the opposite free end of the straight line in the cable grid by a cable stay bolt 13.

The secondary cable routing technique in the present invention utilizes the intermediate pulley 11 which is contained captive within the inner tubing section 4b, and this cable routing technique depicts routing the cable 12 in a similar manner: The cable 12 originates at the anchor point 13, and the cable 12 proceeds vertically upwardly,(contained within the outer tubing section 4a) to pass over the intermediate pulley 11, then passes vertically downwardly, to pass under an lower pulley 8, then proceeds horizontally in free space to the next inline suspension pier 4, passing under a lower pulley 8, there, then the cable 12 proceeds vertically upwardly, (contained within the outer tubing section 4a) to pass over an intermediate pulley 11, etc . . . finally being anchored at the opposite free end by a cable stay bolt 13. This technique is used within the present cable suspension whenever it is desired to have individual cables 12 cross over other separate individual cables 12.

A captive slidable and rotatable steel plate coupler platform 18 is provided at the inner tubing section 4b and visually appears as two concentric circles when viewed from above. The coupler platform 18 is preferably constructed of interlocking heavy flat steel plate, and it is coated on all of it's load bearing faces with a friction reducing coating like teflon or a similar material. The coupler platform 18 is identified as having two separate parts; the captive rotatible element 18a, and the captivating enclosure 18b. Additionally, the inner tubing section 4b is divided into two separate segments to accommodate this coupler platform 18;

The footing mount segment 7; and

The uppermost segment 7a.

This coupler platform 18 provides cushioning for a degree of lateral or shaking movement of the laminated beam 2 and supported structure (relative to any movement of the outer tubing section 4a and the concrete footing 6) The coupler platform 18 captivating enclosure 18b is mounted to the uppermost segment 7a and it's captive rotatable element 18a is permanently mounted to the footing mount segment 7.

The coupler platform 18 rotatably joins the inner tubing section 4b footing mount segment 7 to the uppermost segment 7a. The coupler platform 18 provides a stable and flattened foot for the uppermost segment 7a. The coupler platform 18 is mounted to the footing mount segment 7 at a point approximately 4 inches above the top face of the concrete footing 6. The footing mount segment 7 of the inner tubing section 4b is permanently embedded into the concrete footing 6. The present design of the coupler platform 18 allows for an overall side to side movement of 6 inches, and a 3 inch side to side movement from centerpoint, but larger movement amounts could be designed for. The coupler platform 18 also provides for a rotation ability of the concrete footing 6, relative to the uppermost segment 7a, and isolates the uppermost segment 7a from the concrete footing 6. This arrangement of the cables 12, operating in conjunction with the telescoping suspension piers 4, and the rotatible coupler platform 18 compensates for ground wave induced motion.

Additionally, an optional ball joint leveling coupler 22 is provided below the coupler platform 18. The ball coupler 22 allows the concrete footing 6 to angularly shift from it's original vertical position during seismic activity without transferring the displacement angle to the footing mount segment 7a and the rest of the present cable suspension system. The ball coupler 22 is utilized in land areas which have particularly loose soil or as deemed necessary by site inspection.

The present cable suspension system performs a useful function in supporting a structure during seismic activity. Any vertical movement of any of the individual inner tubing sections 4b causes a tightening or loosening of the cable 12 network throughout the entire array. The response time is immediate, and the suspension system thus autolevels the entire array, absorbing ground wave motion before it reaches the supported load or building. Vertical movement experienced on any footing 6 sensor position within the array will result in system movement and full compensation for all components in the cable network.

When the present invention is utilized to support an inhabitable structure, and to enhance building safety for occupants, a series of flexible utility and sewage couplings are employed. The flexible couplers provide for a moderate amount of seismic disturbances movement without disconnecting the building from it's utilities, and are known in the art.

In certain geographical areas,when used to support an inhabitable structure, the present cable suspension system is protected and contained under the supported structure through use of a series of laminated panelized 'basement wall panels' 20 which reside within and between metallic I beam containment channels 21. The I beam channels 21 are vertically driven deep into the earth outboard of the supported structure 'drip line' and project upwardly to a variable dimension dependent on building sites. The panelized wall sections 20 are preferably faced with a rot and moisture proof, semi flexible facing such as compressed silica board or fiberglass composites, and the panels 20 are filled with an insulative bonding foam between the facings.

A flexible double wall insulative skirt membrane 19 provides a weather and rodent proof cap which is capable of movement with the supported structure. The skirt membrane 19 is mounted to the supported structure and overlaps the panelized basement wall panels 20, and is bermed into the earth beyond the drip line adjacent to the supported structure. The flexible membrane 19 moveably connects the laminated beams 2 of the supported building with the optional wall panels 20 as is necessary to compensate for movement of the wall panels 20 relative to the laminated foundation beam 2 during seismic activity.

Although the present invention has been described herein with particularity, relative to the foregoing detailed description of the preferred embodiment, i wish it to be understood that this description of the disclosed invention is done to fully comply with the requirements of 35 USC Sect. 112, and is not intended to limit the invention in any way. Various modifications, additions, and applications other than those specifically outlined herein will be readily apparent, without departing from the spirit and scope of my present invention, to those having ordinary skill in the art. In example, although the present invention is described herein as utilizing single individual pulleys 8, 10, 11, it is anticipated that a multi-pulley or gang-pulley system and multiple parallel cables 12 could be employed as is known in the art, to allow for heavier loads, stresses, or larger building support. Accordingly, it is desired that the scope of my present invention be determined not entirely by the foregoing specification, and the embodiments illustrated, but that it be defined by the appended claims and their legal equivalents.

We claim:

1. A gravity actuated system of resiliently supporting a structure upon an earthen building site, for the purpose of absorbing and mitigating earth tremors and earth movements, utilizing a building platform, multiple telescoping piers, multiple cables, multiple pulleys, and pivotable, slidable, and rotatable load bearing elements, said method comprising:

a factory fabricated building platform assembly for use as a base platform in the construction of homes, buildings and bridges which building platform is built in two or more separate linear portions intended for later joining, each containing a multiple, laminated lower framework with flooring joists interspersed and connected therewith, and said lower framework has a flat decking attached, suitable for building upon;

a plurality of steel threaded clamping rods having a structural integrity which secure and strengthen the structural integrity of the separate linear portions, and hold said separate linear portions rigidly together to form a complete building platform assembly; and a multiplicity of corrosion resistant large diameter cable portions, that have both free ends anchored to an anchor means underneath said building platform, said cable portions together forming a cable network grid underneath said building platform, and said cable network communicates with and operates in conjunction with;

a multiplicity of parallel, tubular, segmented, telescoping piers which lower segment resides in the earthen building site, and project upwardly from the earthen building site, and which telescoping upper segment is rigidly attached to the building platform assembly lower framework, and said upper segment is supported solely by said cable portions, and said telescoping piers cooperate in conjunction with seismic disturbances and said cable network to provide a vertically moveable and height adjustable supple support means for the said building platform;

a multiplicity of deep groove pulleys mounted internally and externally upon both said telescoping pier segments, providing a rotatable bearing means for said cable portions, and said cable portions cooperate and communicate with said pulleys to lift or lower said telescoping pier segments;

a captive, rotatable and slidable lower mounting platform, mounted inline with each individual telescoping pier lower segment, and the said rotatable slidable platform is placed to centrally bear upon a thick neck ball joint coupler, said ball joint coupler resides vertically inline with said telescoping pier lower segment, and the ball joint coupler is vertically mounted to the earthen building site by means of a reinforced concrete footing;

a thickened, rot proofed, resilient shock absorbing lower facing placed underneath said concrete footing for absorbing initial seismic shock pounding.

2. The resilient support system method of claim 1 wherein an excavation is made under the building platform and a multiplicity of steel channel I beams are driven vertically into the earthen building site, nearby the outer perimeter of said excavation, and under the building platform, and said I beams slidably contain a series of laminated rot proofed wall panels, said I beams and said wall panels together comprise a moveable wall system not permanently connected to said building platform, and a flexible insulative membrane resiliently connects the building platform with said wall panels as a weather proof seal.

* * * * *